US005898365A

United States Patent [19]

Niederlein

[11] Patent Number: 5,898,365

[45] Date of Patent: Apr. 27, 1999

[54] DEVICE FOR CHECKING THE CLOSED STATE OF A DOOR MOUNTED ON AN OBJECT, ESPECIALLY ON A MOTOR VEHICLE

[75] Inventor: Horst Niederlein, Bingen, Germany

[73] Assignee: NSM Aktiengesellschaft, Bingen, Germany

[21] Appl. No.: 08/875,280

[22] PCT Filed: Jan. 17, 1996

[86] PCT No.: PCT/DE96/00090

§ 371 Date: Oct. 3, 1997

§ 102(e) Date: Oct. 3, 1997

[87] PCT Pub. No.: WO96/22439

PCT Pub. Date: Jul. 25, 1996

[30] Foreign Application Priority Data

Jan. 21, 1995 [DE] Germany ..... 195 01 777

[51] Int. Cl.[6] ..... G08B 21/00

[52] U.S. Cl. ..... 340/425.5; 49/14; 180/287; 180/289; 340/540; 340/825.37; 341/176

[58] Field of Search ..... 340/540, 541, 340/542, 425.5, 691, 825.37; 49/14; 180/287, 289; 341/176

[56] References Cited

U.S. PATENT DOCUMENTS

| | | | |
|---|---|---|---|
| 4,908,605 | 3/1990 | Takatsuka | 340/542 |
| 5,025,426 | 6/1991 | Blumberg et al. | 340/542 |

FOREIGN PATENT DOCUMENTS

| | | |
|---|---|---|
| 91 11 651 U | 1/1992 | Germany . |
| 4104119 | 8/1992 | Germany . |
| 2240418 | 7/1991 | United Kingdom . |

*Primary Examiner*—Glen Swann
*Attorney, Agent, or Firm*—Venable; Norman N. Kunitz; Allen Wood

[57] ABSTRACT

The invention relates to a device for checking the closed state of a door mounted on an object (1), especially on a motor vehicle, by using an electronic key (2). The electronic key (2) and the object (1) are each fitted with intercommunicating transmitter/receiver units (3, 4 or 13, 14). The closed state of the door (1) is determined via a closure detecting sensor (8) on the door (7) and indicated via optical displays (10 or 16) on the outside of the object (1) and/or on the electronic key (2).

23 Claims, 1 Drawing Sheet

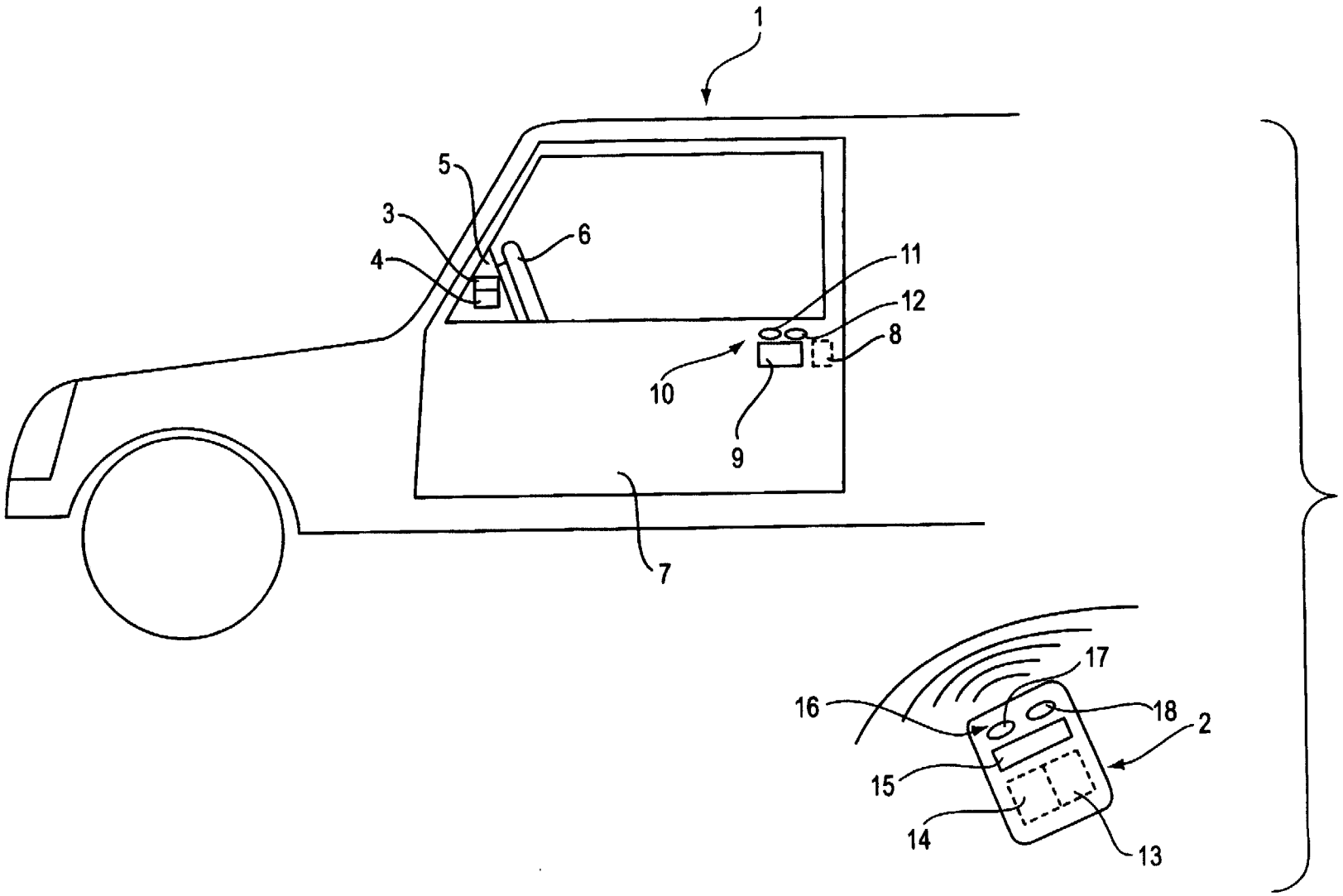
1
2
3
4
5
6
7
8
9
10
11
12
13
14
15
16
17
18

DEVICE FOR CHECKING THE CLOSED STATE OF A DOOR MOUNTED ON AN OBJECT, ESPECIALLY ON A MOTOR VEHICLE

BACKGROUND OF THE INVENTION

The invention concerns a device for checking the closed state of a door mounted on an object, in particular on a motor vehicle, by means of an electronic key with an optical display, wherein the object and the electronic key respectively have a transmitter and a receiver that intercommunicate within a defined spatial region.

Particular attention has been paid in recent years to protecting motor vehicles against break-in and theft. It has been contemplated to provide motor vehicles with preferably electronic security systems, which are designed to prevent access to a motor vehicle by unauthorized persons or to make this more difficult. For this, motor vehicles are equipped with electronic theft protection devices, vehicle immobilization systems and alarm systems. Electronic systems of this type frequently have electronic displays in the form of light-emitting diodes, which light up when the system is "alarmed" and which indicate whether an alarm system, theft protection device or vehicle immobilization system is activated.

Particular attention is paid to the doors as access elements of the motor vehicle. Increasingly, doors are provided with electronic locks that can be operated with an electronic key, preferably a remote control. The doors generally can be opened and closed only by the owner of the electronic key.

An electronic key designed as remote control is known, which unlocks the doors of a motor vehicle upon activation of a button. When leaving the motor vehicle, all doors of the motor vehicle can be locked by pushing another button. The doors have closure detecting sensors that intercommunicate with a receiver located inside the motor vehicle. If the user of the motor vehicle wants to check whether all doors of the motor vehicle are closed, then he/she can activate the door-locking button on the electronic key again within a spatially limited range. If all doors are closed, then the receiver unit installed inside the motor vehicle emits an impulse to an acoustic signaling device, the motor vehicle horn, which then confirms the closed state of the door with a short acoustic beep. If one of the doors is not closed, no acoustic signal is emitted. One particular disadvantage of this device is that this acoustic signal sound as a rule is viewed as disrupting to the environment, in particular at night or in parking garages. In an acoustically noisy environment, the acoustic signal frequently cannot be assigned to the respective motor vehicle. Finally, an acoustic sound is not suited to continuously indicate the "closed" state of the motor vehicle. A reassurance as to whether the doors of the motor vehicle are actually locked can be gained only through repeated activation of the locking button on the electronic key, wherein it is not possible to visually observe the locked state of the door.

In accordance with the GB-A-2 240 418, a remote control for motor vehicle doors essentially comprises a portable remote control unit and a control unit arranged inside the motor vehicle. Each of these units has a transmitter and a receiver, which intercommunicate within a defined spatial region, so that an exchange of information occurs, which signals the closed state of the door mounted on the motor vehicle. A display means mounted on the remote control unit visually displays whether the motor vehicle door is closed or not.

A similar locking arrangement for one or several lockable covers over motor vehicle openings is disclosed in the DE-U-91 11 651. The locking arrangement comprises a hand-held transmitter with receiver, as well as respectively one receiver and one transmitter arranged in the motor vehicle, which intercommunicate. A lock installed on a cover for the motor vehicle is connected to a sensor in a way that is not elaborated upon, which sensor detects the closed state of the lock and transmits a corresponding signal to a control unit arranged in the motor vehicle. This control unit pulses the associated transmitter, which then transmits a signal to the hand-held transmitter/receiver unit.

An optical display of an alarm system in a motor vehicle also shows only whether or not the alarm system is operational. However, it does not show whether the doors are open or closed.

SUMMARY OF THE INVENTION

Thus, it is the object of the present invention to create a device for checking the closed state of a door on an object, in particular on a motor vehicle, which generates signals that can be visually observed for transmitting the "open" or "closed" state of doors to the user after leaving the object.

According to the present invention, the above object is achieved by arranging the display on the key so as continuously to show the "open" or "closed" state of the door when the button on the key is activated.

In this way, when the key is pushed there is obtained a visually observable continuous display on the electronic key, which means that the user of the key will at any time receive a visual return message concerning the closed state of the door by looking at the key, that is inside as well as outside of the spatially defined region for intercommunication between transmitters and receivers. By pushing the button on the electronic key, the optical display on the electronic key is activated and indicates the respective state of the door. The object may be a motor vehicle, or an entertainment machine, such as a money-operated game machine, a dart-gaming machine, a juke-box, or the like.

The optical display is preferably a light-emitting diode. In this case, the "on" state of the light-emitting diode can indicate the "locked" state of the door and the "off" state of the light-emitting diode the "open" state of the door. As an alternative, the optical display for that purpose comprises two light-emitting diodes displaying different colors. In that case one of the light-emitting diodes lights up green to indicate the "open" state of the door and the other light-emitting diode lights up red to indicate the "closed" state of the door. This results in a particularly reliable way of detecting the closed state of a door mounted on an object.

In another embodiment of the invention, the trunk lid and/or the engine compartment lid are also included in the check of the closed state of the door or doors mounted on a motor vehicle. With this, all access areas to the motor vehicle are on principle included in the check of the closed state. Besides being able to check the closed state of the doors mounted on a motor vehicle, access by unauthorized persons to the motor vehicle and the theft of the motor vehicle are thus made more difficult.

A closure detecting sensor is preferably arranged at the door or flap for detecting the closed state of a door mounted on the object, which sensor is linked to the transmitter/receiver unit in the object.

The electronic key may be a remote control unit which communicates via infrared, ultrasound, or radio.

BRIEF DESCRIPTION OF THE DRAWING

The single FIGURE in the drawing shows a section of a motor vehicle in connection with an electronic key.

DESCRIPTION OF THE PREFERRED EMBODIMENT

The device for checking the closed state of a door consists of the motor vehicle 1, which contains essential parts of the device, and the associated electronic key 2. The motor vehicle 1 is provided on the inside with a unit comprised of transmitter 3 and receiver 4. This unit can preferably be installed in the instrument panel 5, behind the steering wheel 6.

The associated drawing shows only the driver's side door 7. However, the following explanations concerning this refer to all other doors as well as the motor compartment flap and the trunk lid of the motor vehicle 1. A closure detecting sensor 8 is installed in the door 7, which sensor intercommunicates with the transmitter/receiver unit 3, 4 in the motor vehicle 1. The closure detecting sensor 8 is preferably arranged near the door handle 9 of door 7 of motor vehicle 1. An optical display 10 is also provided in the region of the door handle 9, which comprises two light-emitting diodes 11 and 12 displaying different colors, e.g. red and green.

The electronic key 2 has an additionally installed unit, comprising a transmitter 13 and a receiver 14. Once a button 15 is activated on the electronic key 2, this unit communicates with the unit inside motor vehicle 1, which is comprised of the transmitter 3 and the receiver 4. The electronic key 2 like the motor vehicle 1 has an optical display 16 comprising two light-emitting diodes 17 and 18 displaying different colors, e.g. red and green.

With the invention at hand, a device for checking the closed state of a door mounted on an object has been created, by means of which signals are generated on the object 1 and/or the electronic key 2 that can be observed visually. These signals indicate to the user whether the door or doors or the flaps on the object are open or closed.

I claim:

1. A device for indicating whether a door mounted on an object is in an open state or a closed state, comprising:

an electronic key having a button and an optical display, the electronic key additionally having a transmitter and a receiver: and a transmitter and a receiver carried by the object, the transmitter and receiver of the electronic key intercommunicating with the transmitter and receiver carried by the object within a defined spatial region.

wherein the optical display continuously indicates the open or closed state of the door upon activation of the button, and wherein the optical display comprises a light-emitting diode.

2. The device of claim 1, wherein the object is a motor vehicle.

3. A device for indicating whether a door mounted on an object is in an open state or a closed state, comprising:

an electronic key having a button and an optical display, the electronic key additionally having a transmitter and a receiver, and a transmitter and a receiver carried by the object, the transmitter and receiver of the electronic key intercommunicating with the transmitter and receiver carried by the object within a defined spatial region, wherein the optical display continuously indicates the open or closed state of the door upon activation of the button, and wherein the optical display comprises two light-emitting diodes displaying different colors.

4. A device according to claim 3, wherein one of the light-emitting diodes lights up green to indicate the open state of the door and the other light-emitting diode lights up red to indicate the closed state of the door.

5. The device of claim 3, wherein the device is a motor vehicle.

6. A device for indicating whether a door mounted on an object is in an open state or a closed state, comprising:

an electronic key having an optical display, the electronic key additionally having a transmitter and a receiver;

a transmitter and receiver carried by the object, the transmitter and receiver of the key intercommunicating with the transmitter and receiver carried by the object within a defined region; and an optical display on the outside of the door to show whether the state of the door is open or closed.

7. A device according to claim 6, wherein the object is a motor vehicle having a trunk with a lid and an engine compartment with a lid, and further comprising means for checking whether at least one of the lids is in an open state or a closed state.

8. A device according to claim 6, further comprising a closure detecting sensor arranged on the door, the sensor being linked to at least one of the transmitter and the receiver carried by the object.

9. A device according to claim 6, wherein the electronic key is a remote control unit.

10. A device according to claim 9, wherein the remote control unit is an infrared remote control unit.

11. A device according to claim 9, wherein the remote control unit is an ultrasound remote control unit.

12. A device according to claim 9, wherein the remote control unit is a radio remote control unit.

13. The device of claim 6, wherein the optical display comprises a light-emitting diode.

14. The device of claim 6, wherein the optical display comprises two light-emitting diodes displaying different colors.

15. The device of claim 14, wherein one of the light-emitting diodes lights up green to indicate the open state of the door and the other light-emitting diode lights up red to indicate the closed state of the door.

16. The device of claim 6, wherein the object is a motor vehicle.

17. A system for indicating whether a door mounted on an object is in a first state or a second state, comprising:

an electronic key having a button and a communications unit;

a communications unit carried by the object to communicate with the communications unit of the electronic key;

sensor means for sensing whether the door is in its first state or its second state, the sensor means being linked to the communications unit carried by the object; and an optical display on the door to show whether the door is in its first state or its second state when the button is activated, the optical display being linked to the communications unit carried by the object.

18. A system according to claim 17, wherein the optical display comprises a light-emitting component.

19. A system according to claim 18, wherein the light-emitting component is an LED.

20. A system according to claim 19, wherein the light-emitting components are LEDs.

21. A system according to claim 17, wherein the optical display comprises a plurality of light-emitting components which light up with different colors.

22. A system according to claim 17, wherein the communications unit of the electronic key comprises a transmitter and the communications unit carried by the object comprises a receiver.

23. A system according to claim 17, wherein the object is a car.

* * * * *